US008798299B1

(12) United States Patent
Higgins et al.

(10) Patent No.: US 8,798,299 B1
(45) Date of Patent: Aug. 5, 2014

(54) MAGNETIC SHIELDING FOR COMMUNICATION DEVICE APPLICATIONS

(75) Inventors: Sidney A. Higgins, Maple Grove, MN (US); James R. Newton, Burnsville, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 755 days.

(21) Appl. No.: 12/644,188

(22) Filed: Dec. 22, 2009

Related U.S. Application Data

(60) Provisional application No. 61/142,083, filed on Dec. 31, 2008.

(51) Int. Cl.
*H04R 25/00* (2006.01)

(52) U.S. Cl.
USPC ..... 381/322; 381/330; 381/189

(58) Field of Classification Search
USPC ..... 381/312, 319, 322, 324, 328, 330, 189; 455/300, 575.5; 361/816, 818
See application file for complete search history.

(56) References Cited

U.S. PATENT DOCUMENTS

| | | | | |
|---|---|---|---|---|
| 2,327,320 | A * | 8/1943 | Shapiro | 381/319 |
| 3,728,509 | A | 4/1973 | Shimojo | |
| 3,812,300 | A | 5/1974 | Brander et al. | |
| 4,017,834 | A | 4/1977 | Cuttill et al. | |
| 4,310,213 | A | 1/1982 | Fetterolf, Sr. et al. | |
| 4,571,464 | A | 2/1986 | Segero | |
| 4,729,166 | A | 3/1988 | Lee et al. | |
| 5,606,621 | A | 2/1997 | Reiter et al. | |
| 5,640,457 | A | 6/1997 | Gnecco et al. | |
| 5,687,242 | A | 11/1997 | Iburg | |
| 5,708,720 | A * | 1/1998 | Meyer | 381/322 |
| 5,740,261 | A | 4/1998 | Loeppert et al. | |
| 5,755,743 | A | 5/1998 | Volz et al. | |
| 5,824,968 | A | 10/1998 | Packard et al. | |
| 5,825,894 | A | 10/1998 | Shennib | |
| 5,987,146 | A | 11/1999 | Pluvinage et al. | |
| 6,031,923 | A * | 2/2000 | Gnecco et al. | 381/322 |
| 6,167,138 | A | 12/2000 | Shennib | |
| 6,563,045 | B2 | 5/2003 | Goett et al. | |
| 6,766,030 | B1 | 7/2004 | Chojar | |
| 6,876,074 | B2 | 4/2005 | Kim | |
| 7,003,127 | B1 | 2/2006 | Sjursen et al. | |
| 7,016,512 | B1 | 3/2006 | Freeley et al. | |
| 7,065,224 | B2 | 6/2006 | Cornelius et al. | |
| 7,110,562 | B1 | 9/2006 | Feeley et al. | |
| 7,139,404 | B2 | 11/2006 | Feeley et al. | |
| 7,142,682 | B2 | 11/2006 | Mullenborn et al. | |
| 7,181,035 | B2 | 2/2007 | van Halteren et al. | |
| 7,256,747 | B2 | 8/2007 | Victorian et al. | |
| 7,446,720 | B2 | 11/2008 | Victorian et al. | |
| 7,460,681 | B2 | 12/2008 | Geschiere et al. | |
| 7,471,182 | B2 | 12/2008 | Kumano et al. | |
| 7,593,538 | B2 | 9/2009 | Polinske | |
| 8,098,863 | B2 | 1/2012 | Ho et al. | |
| 8,295,517 | B2 | 10/2012 | Gottschalk et al. | |
| 8,385,573 | B2 | 2/2013 | Higgins | |
| 8,494,195 | B2 | 7/2013 | Higgins | |
| 2002/0061113 | A1 | 5/2002 | van Halteren et al. | |
| 2002/0131614 | A1 | 9/2002 | Jakob et al. | |
| 2003/0178247 | A1 | 9/2003 | Saltykov | |
| 2003/0200820 | A1 | 10/2003 | Takad et al. | |
| 2004/0010181 | A1 | 1/2004 | Feeley et al. | |
| 2004/0028251 | A1 | 2/2004 | Kasztelan et al. | |
| 2004/0114776 | A1 | 6/2004 | Crawford et al. | |
| 2004/0240693 | A1 | 12/2004 | Rosenthal | |
| 2005/0008178 | A1 | 1/2005 | Joergensen et al. | |
| 2006/0018495 | A1 | 1/2006 | Geschiere et al. | |
| 2006/0097376 | A1 | 5/2006 | Leurs et al. | |
| 2006/0159298 | A1 | 7/2006 | Von Dombrowski et al. | |
| 2007/0009130 | A1 | 1/2007 | Feeley et al. | |
| 2007/0036374 | A1 | 2/2007 | Bauman et al. | |
| 2007/0121979 | A1 | 5/2007 | Zhu et al. | |
| 2007/0188289 | A1 | 8/2007 | Kumano et al. | |
| 2007/0248234 | A1 | 10/2007 | Ho et al. | |
| 2008/0003736 | A1 | 1/2008 | Arai et al. | |
| 2008/0026220 | A9 | 1/2008 | Bi et al. | |
| 2008/0187157 | A1 | 8/2008 | Higgins | |
| 2008/0199971 | A1 | 8/2008 | Tondra | |
| 2008/0260193 | A1 | 10/2008 | Westermann et al. | |
| 2009/0074218 | A1 | 3/2009 | Higgins | |
| 2009/0075083 | A1 | 3/2009 | Bi et al. | |
| 2009/0196444 | A1 | 8/2009 | Solum | |

(Continued)

FOREIGN PATENT DOCUMENTS

| | | |
|---|---|---|
| DE | 1247402 | 8/1967 |
| DE | 3006235 A1 | 10/1980 |

(Continued)

OTHER PUBLICATIONS

"U.S. Appl. No. 11/857,439 , Response filed Dec. 17, 2011 to Non Final Office Action mailed Aug. 17, 2011", 12 pgs.
"U.S. Appl. No. 11/857,439, Non Final Office Action mailed Aug. 17, 2011", 16 pgs.
"U.S. Appl. No. 12/027,173, Final Office Action mailed Dec. 8, 2011", 12 pgs.
"U.S. Appl. No. 12/027,173, Non Final Office Action mailed Jul. 11, 2011", 10 pgs.
"U.S. Appl. No. 12/027,173, Response filed Nov. 14, 2011 to Non Final Office Action mailed Jul. 11, 2011", 8 pgs.
"U.S. Appl. No. 12/548,051, Non Final Office Action mailed Oct. 12, 2011", 11 pgs.
"European Application Serial No. 08253065.0, European Examination Notification mailed Oct. 11, 2011", 7 pgs.

(Continued)

*Primary Examiner* — Huyen D Le
(74) *Attorney, Agent, or Firm* — Schwegman, Lundberg & Woessner, P.A.

(57) ABSTRACT

A communication device comprising a coated surface having a fine grained coating, the coating including a high nickel content to provide magnetic shielding. The present coating process can be applied to a variety of components and surfaces to provide magnetic shielding in a communications device. Such devices, include, but are not limited to cell phones, hearing aids, and other hearing assistance devices.

12 Claims, No Drawings

(56) References Cited

U.S. PATENT DOCUMENTS

| | | | |
|---|---|---|---|
| 2009/0245558 | A1 | 10/2009 | Spaulding |
| 2009/0262964 | A1 | 10/2009 | Havenith et al. |
| 2010/0034410 | A1 | 2/2010 | Link et al. |
| 2010/0074461 | A1 | 3/2010 | Polinske |
| 2010/0124346 | A1 | 5/2010 | Higgins |
| 2010/0135513 | A1 | 6/2010 | Geschiere et al. |
| 2010/0158291 | A1 | 6/2010 | Polinske et al. |
| 2010/0158293 | A1 | 6/2010 | Polinske et al. |
| 2010/0158295 | A1 | 6/2010 | Polinske et al. |
| 2011/0044485 | A1 | 2/2011 | Lin et al. |
| 2012/0014549 | A1 | 1/2012 | Higgins et al. |
| 2012/0263328 | A1 | 10/2012 | Higgins |
| 2013/0230197 | A1 | 9/2013 | Higgins |

FOREIGN PATENT DOCUMENTS

| | | | |
|---|---|---|---|
| DE | 3502178 | A1 | 8/1985 |
| DE | 3643124 | A1 | 7/1988 |
| DE | 4005476 | A1 | 7/1991 |
| DE | 9320391 | | 9/1993 |
| DE | 4233813 | C1 | 11/1993 |
| DE | 9408054 | U1 | 5/1994 |
| DE | 29801567 | U1 | 5/1998 |
| DE | 102008045668 | A1 | 9/2008 |
| EP | 0339877 | A3 | 11/1989 |
| EP | 0424916 | B1 | 7/1995 |
| EP | 0866637 | A2 | 9/1998 |
| EP | 1065863 | A2 | 1/2001 |
| EP | 1209948 | A2 | 5/2002 |
| EP | 1465457 | A2 | 10/2004 |
| EP | 1496530 | A2 | 1/2005 |
| EP | 1209948 | A3 | 7/2006 |
| EP | 1811808 | A1 | 7/2007 |
| EP | 1816893 | A1 | 8/2007 |
| EP | 1850630 | A2 | 10/2007 |
| EP | 1916561 | A2 | 4/2008 |
| EP | 1916561 | A3 | 4/2008 |
| EP | 1920634 | B1 | 2/2009 |
| EP | 2040343 | A1 | 3/2009 |
| EP | 2509341 | A1 | 10/2012 |
| EP | 2160047 | B1 | 10/2013 |
| GB | 1298089 | | 11/1972 |
| GB | 1522549 | | 8/1978 |
| GB | 1522549 | B3 | 8/1978 |
| JP | 2209967 | A | 8/1990 |
| JP | 2288116 | A | 11/1990 |
| JP | 09199662 | | 7/1997 |
| WO | WO-0079832 | A2 | 12/2000 |
| WO | WO-2004025990 | A1 | 3/2004 |
| WO | WO-2006094502 | A1 | 9/2006 |
| WO | WO-2007027152 | A1 | 3/2007 |
| WO | WO-2007112404 | A2 | 10/2007 |
| WO | WO-2007112404 | A3 | 10/2007 |
| WO | WO-2007140403 | A2 | 12/2007 |
| WO | WO-2007140403 | A3 | 12/2007 |
| WO | WO-2007148154 | A1 | 12/2007 |
| WO | WO-2008092265 | A1 | 8/2008 |
| WO | WO-2008097600 | A1 | 8/2008 |
| WO | WO-2008097600 | C1 | 8/2008 |
| WO | WO-2011101041 | A1 | 8/2011 |

OTHER PUBLICATIONS

"European Application Serial No. 08725262.3, Office Action mailed Aug. 5, 2011", 5 pgs.
"European Application Serial No. 09168844.0, Office Action mailed Apr. 28, 2011", 5 pgs.
"U.S. Appl. No. 10/894,576, Non-Final Office Action mailed Jul. 2, 2007", 12 pgs.
"U.S. Appl. No. 10/894,576, Non-Final Office Action mailed Dec. 18, 2007", 11 pgs.
"U.S. Appl. No. 10/894,576, Notice of Allowance mailed Aug. 5, 2008", 7 pgs.
"U.S. Appl. No. 10/894,576, Response filed Apr. 18, 2008 to Non-Final Office Action mailed Dec. 18, 2007", 10 pgs.
"U.S. Appl. No. 10/894,576, Response filed Oct. 1, 2007 to Non-Final Office Action mailed Jul. 2, 2007", 10 pgs.
"U.S. Appl. No. 11/857,439, Final Office Action mailed Feb. 29, 2012", 16 pgs.
"U.S. Appl. No. 11/857,439, Response filed Apr. 30, 2012 to Final Office Action mailed Feb. 29, 2012", 9 pgs.
"U.S. Appl. No. 12/325,838, Non Final Office Action mailed Jun. 16, 2011", 5 pgs.
"U.S. Appl. No. 12/548,051, Response filed Jan. 12, 2012 to Non Final Office Action mailed Oct. 12, 2011", 9 pgs.
"U.S. Appl. No. 12/548,051,Final Office Action mailed Apr. 19, 2012", 12 pgs.
"European Application Serial No. 08253065.0, Response filed Feb. 8, 2012 to Examination Notification mailed Oct. 11, 2011", 15 pgs.
"European Application Serial No. 08725262.3, Response filed Feb. 13, 2012 to Office Action mailed Aug. 5, 2011", 11 pgs.
"European Application Serial No. 09168844.0, Response filed Feb. 24, 2012 to Office Action mailed Apr. 28, 2011", 12 pgs.
"European Application Serial No. 10251319.9, Office Action mailed Jan. 3, 2012", 6 pgs.
"U.S. Appl. No. 11/857,439, Response filed Jun. 13, 2011 to Restriction Requirement mailed May 11, 2011", 8 pgs.
"U.S. Appl. No. 11/857,439, Restriction Requirement Action mailed May 11, 2011", 6 pgs.
"European Application Serial No. 08253065.0, European Office Action mailed Aug. 26, 2010", 6 Pgs.
"European Application Serial No. 08253065.0, Extended Search Report Mailed Dec. 15, 2008", 9 pgs.
"European Application Serial No. 08253065.0, Office Action mailed Jul. 17, 2009", 1 pg.
"European Application Serial No. 08253065.0, Response filed Jan. 26, 2010 to Office Action mailed Jul. 17, 2009", 9 pgs.
"European Application Serial No. 08253065.0, Response to Office Action filed Feb. 28, 2011 to European Office Action mailed Aug. 26, 2010", 17 pgs.
"European Application Serial No. 08725262.3, Office Action mailed Apr. 21, 2010", 6 Pgs.
"European Application Serial No. 08725262.3, Office Action Response Filed Nov. 2, 2010", 14 pgs.
"European Application Serial No. 09168844.0, European Search Report mailed Apr. 19, 2010", 3 Pgs.
"European Application Serial No. 09168844.0, Office Action mailed May 3, 2010", 5 pgs.
"European Application Serial No. 09168844.0, Office Action Response Filed: Nov. 15, 2010", 8 pgs.
"European Application Serial No. 09250729.2, Extended Search Report Mailed Dec. 14, 2009", 4 pgs.
"International Application Serial No. PCT/US2008/001609, International Preliminary Report on Patentability mailed Aug. 20, 2009", 10 pgs.
"International Application Serial No. PCT/US2008/001609, Search Report mailed Jun. 19, 2008", 7 pgs.
"International Application Serial No. PCT/US2008/001609, Written Opinion mailed Jun. 19, 2008", 8 pgs.
Buchoff, L S, "Advanced Non-Soldering Interconnection", Electro International, 1991 (IEEE), XP 10305250A1, (1991), 248-251.
Tondra, Mark, "U.S. Appl. No. 60/887,609, filed Feb. 1, 2007", 28 pgs.
"U.S. Appl. No. 11/857,439, Notice of Allowance mailed May 30, 2012", 9 pgs.
"U.S. Appl. No. 11/857,439, Notice of Allowance mailed Sep. 19, 2012", 9 pgs.
"U.S. Appl. No. 12/027,173, Non Final Office Action mailed Jul. 27, 2012", 11 pgs.
"U.S. Appl. No. 12/027,173, Notice of Allowance mailed Mar. 19, 2013", 8 pgs.
"U.S. Appl. No. 12/027,173, Response filed Jun. 8, 2012 to Final Office Action mailed Dec. 8, 2011", 7 pgs.
"U.S. Appl. No. 12/027,173, Response filed Dec. 26, 2012 to Non Final Office Action mailed Jul. 27, 2012", 8 pgs.
"U.S. Appl. No. 12/539,195, Advisory Action mailed Apr. 23, 2013", 3 pgs.

(56) References Cited

OTHER PUBLICATIONS

"U.S. Appl. No. 12/539,195, Final Office Action mailed Feb. 11, 2013", 15 pgs.
"U.S. Appl. No. 12/539,195, Non Final Office Action mailed Jul. 20, 2012", 13 pgs.
"U.S. Appl. No. 12/539,195, Non Final Office Action mailed Aug. 2, 2013", 14 pgs.
"U.S. Appl. No. 12/539,195, Response filed Apr. 11, 2013 to Final Office Action mailed Feb. 11, 2013", 7 pgs.
"U.S. Appl. No. 12/539,195, Response filed Dec. 20, 2012 to Non Final Office Action mailed Jul. 20, 2012", 7 pgs.
"U.S. Appl. No. 12/548,051, Non Final Office Action mailed Jan. 24, 2013", 12 pgs.
"U.S. Appl. No. 12/548,051, Notice of Allowance mailed Jul. 31, 2013", 14 pgs.
"U.S. Appl. No. 12/548,051, Response filed Apr. 24, 2013 to Non Final Office Action mailed Jan. 24, 2013", 8 pgs.
"U.S. Appl. No. 12/548,051, Response filed Sep. 19, 2012 to Final Office Action mailed Apr. 19, 2012", 8 pgs.
"U.S. Appl. No. 12/842,305, Examiner Interview Summary mailed Apr. 19, 2013", 3 pgs.
"U.S. Appl. No. 12/842,305, Response filed Feb. 8, 2013 to Restriction Requirement mailed Feb. 8, 2013", 6 pgs.
"U.S. Appl. No. 12/842,305, Restriction Requirement mailed Feb. 8, 2013", 6 pgs.
"U.S. Appl. No. 13/181,752 , Response filed Jun. 5, 2013 to Non Final Office Action mailed Mar. 5, 2013", 8 pgs.
"U.S. Appl. No. 13/181,752, Final Office Action mailed Jul. 11, 2013", 7 pgs.
"U.S. Appl. No. 13/181,752, Non Final Office Action mailed Mar. 5, 2013", 7 pgs.
"European Application Serial No. 12167845.2, Extended EP Search Report mailed Sep. 12, 2012", 6 pgs.
"European Application Serial No. 08725262.3, EPO Written Decision to Refuse mailed Oct. 19, 2012", 14 pgs.
"European Application Serial No. 08725262.3, Summons to Attend Oral Proceedings mailed Jun. 6, 2012", 5 pgs.
"European Application Serial No. 09168844.0, Office Action mailed Apr. 8, 2013", 5 pgs.
"European Application Serial No. 09168844.0, Office Action mailed May 14, 2012", 2 pgs.
"European Application Serial No. 09168844.0, Response filed Jul. 24, 2012 to Examination Notification Art. 94(3) mailed May 14, 2012", 10 pgs.
"European Application Serial No. 10251319.9, Response filed Jul. 24, 2012 to Extended European Search Report mailed Jan. 3, 2012", 10 pgs.
"European Application Serial No. 12167845.2, Response filed Apr. 10, 2013 to Extended European Search Report mailed Sep. 12, 2012", 14 pgs.
"European Application Serial No. 09168844.0, Office Action mailed Sep. 4, 2012", 4 pgs.
"European Application Serial No. 09168844.0, Response filed Mar. 14, 2013 to Office Action mailed Sep. 4, 2012", 34 pgs.
"U.S. Appl. No. 12/539,195, Notice of Allowance mailed Nov. 29, 2013", 12 pgs.
"U.S. Appl. No. 12/539,195, Response filed Nov. 4, 2013 to Non Final Office Action mailed Aug. 2, 2013", 7 pgs.
"U.S. Appl. No. 13/181,752, Notice of Allowance mailed Sep. 25, 2013", 9 pgs.
"U.S. Appl. No. 13/181,752, Response filed Sep. 11, 2013 to Final Office Action mailed Jul. 11, 2013", 8 pgs.
"U.S. Appl. No. 13/422,177, Non Final Office Action mailed Sep. 26, 2013", 10 pgs.
"U.S. Appl. No. 13/776,557, Non Final Office Action mailed Oct. 22, 2013", 6 pgs.

* cited by examiner

MAGNETIC SHIELDING FOR COMMUNICATION DEVICE APPLICATIONS

CLAIM OF PRIORITY

The present application claims the benefit under 35 U.S.C. 119(e) of U.S. Provisional Patent Application Ser. No. 61/142,083, filed Dec. 31, 2008, which is incorporated herein by reference in its entirety.

TECHNICAL FIELD

This application relates to communication devices and more particularly to magnetic shielding for communication device applications

BACKGROUND

Communication devices often involve compact designs having densely populated components. These components can suffer in performance due to electromagnetic interference during operation. One example of such a communication device is a hearing aid. Hearing aids typically include a device called a "receiver" which plays sound processed by electronics in the hearing aid. The receiver is often close to other components so that magnetic shielding is required. One existing method for shielding a receiver is to draw and anneal mu-metal in the form of a "can" in which the receiver is placed to minimize magnetic interference. However, this approach requires metal working to draw the mu-metal and a separate annealing process to provide alignment of magnetic grain boundaries of the mu-metal. There is a need in the art for an improved magnetic shielding that is easy to use with communication devices and provides a high quality magnetic shielding.

SUMMARY

A communication device comprising a coated surface having a fine grained coating, the coating including a high nickel content to provide magnetic shielding.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

The present subject matter relates to a fine grained coating, including, but not limited to, the nanometer scale grain structures obtained using the processes set forth in U.S. Pat. Nos.

7,320,832 and 7,354,354, which are incorporated by reference herein in their entirety. The inventors proposed using a high nickel content mu-metal formulation for production of the fine grained coatings to provide low-frequency shielding. Mu-metal is a nickel-iron alloy that has very high magnetic permeability. The high permeability makes mu-metal very effective at screening static or low-frequency magnetic fields. Typically, mu-metal objects require heat treatment after they are in final form. One type of heat treatment is annealing. Annealing increases the magnetic permeability about 40 times. However, one advantage of the present process of using a mu-metal formulation with the fine grained coatings is that the resulting object does not require annealing. Another advantage of the present process is that the coatings can be made on plastic or other surfaces. Yet another advantage is that the hardness of the coatings adds to the rigidity of the resulting coated object. Another advantage is that the fine grain structure of the present subject matter can provide grain structures that are substantially smaller than annealed mu-metal. In one embodiment, the grain structure was about 1000 times smaller and tighter than a mu-metal counterpart. Another advantage is that the coated components provided by the present process can be about 6/10ths of the thickness of their mu-metal counterparts and still achieve the same amount of magnetic shielding, so overall coating thicknesses are less.

In one embodiment, an alloy with a high nickel content is formed using the processes described in the references incorporated by reference herein. In one embodiment, an alloy comprising about 75% nickel, about 15% iron, copper and molybdenum alloy is provided. Other concentrations are possible without departing from the scope of the present subject matter.

The present coating process can be applied to a variety of components and surfaces to provide magnetic shielding in a communications device. Such devices, include, but are not limited to cell phones, hearing aids, and other hearing assistance devices.

In hearing aid applications, the plastic of the hearing aid can be coated with the present shielding. It can supplement or entirely replace the current magnetic shielding used with the receiver or speaker of the hearing aid. In various applications the plastic components generated using stereolithography can be coated.

The present subject matter includes hearing assistance devices, including but not limited to, cochlear implant type hearing devices, hearing aids, such as in-the-ear (ITE), in-the-canal (ITC), completely-in-the-canal (CIC), behind-the-ear (BTE), and receiver-in-the-canal (RIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A communication device including a component comprising a coated surface having a fine grained coating having an average grain size less than 1000 nm, the coating including a mu-metal having a high nickel content to provide magnetic shielding, wherein the fine grained coating is layered on the component using a plasma process without annealing.

2. The communication device of claim 1, wherein the component is a receiver.

3. The communication device of claim 2, wherein the receiver is used in a hearing assistance device.

4. The communication device of claim 3, wherein the hearing assistance device is a hearing aid.

5. The communication device of claim 4, wherein the hearing aid is a receiver-in-the-canal hearing aid.

6. The communication device of claim 4, wherein the hearing aid is a behind-the-ear hearing aid.

7. The communication device of claim 4, wherein the hearing aid is an in-the-ear hearing aid.

8. The communication device of claim 4, wherein the hearing aid is a completely-in-the-canal hearing aid.

9. The communication device of claim 1, wherein the communication device is a cell phone.

10. The communication device of claim 1, wherein the component includes plastic.

11. The communication device of claim 1, wherein the component includes plastic generated using stereolithography.

12. The communication device of claim 1, wherein the coating includes an alloy comprising about 75% nickel, and about 15% iron, copper and molybdenum.

* * * * *

UNITED STATES PATENT AND TRADEMARK OFFICE

CERTIFICATE OF CORRECTION

PATENT NO. : 8,798,299 B1
APPLICATION NO. : 12/644188
DATED : August 5, 2014
INVENTOR(S) : Higgins et al.

It is certified that error appears in the above-identified patent and that said Letters Patent is hereby corrected as shown below:

ON THE TITLE PAGE

In column 2, under "U.S. Patent Documents", line 2, after "Higgins", insert --¶8,781,141 7/2014 Higgins et al.--, therefor In column 2, under "U.S. Patent Documents", line 17, after "Zhu et al.", insert --¶2007/0147630 A1 6/2007 Chiloyan--, therefor In column 2, under "U.S. Patent Documents", line 27, after "Solum", insert --¶2009/0252365 A1 10/2009 Lin--, therefor On page 2, in column 1, under "Foreign Patent Documents", line 25, after "10/2013", insert --¶EP 2509341 B1 6/2014--, therefor On page 3, in column 2, under "Other Publications", line 34, after "6, pgs.", insert --¶"U.S. Appl. No. 13/422,177, Non Final Office Action mailed Jul. 16, 2014", 12 pgs.¶"U.S. Appl. No. 14/301,103, Preliminary Amendment filed Jul. 01, 2014", 5 pgs.--, therefor Signed and Sealed this
Twenty-fourth Day of May, 2016

Michelle K. Lee

Michelle K. Lee
*Director of the United States Patent and Trademark Office*